US005871051A

United States Patent [19]

Mann

[11] Patent Number: 5,871,051

[45] Date of Patent: Feb. 16, 1999

[54] METHOD AND RELATED APPARATUS FOR RETRIEVING A ROTARY PUMP FROM A WELLBORE

[75] Inventor: Jay S. Mann, Sherwood Park, Canada

[73] Assignee: Camco International, Inc., Houston, Tex.

[21] Appl. No.: 785,733

[22] Filed: Jan. 17, 1997

[51] Int. Cl.[6] ..... E21B 23/00

[52] U.S. Cl. ..... 166/377; 166/105; 417/360

[58] Field of Search ..... 166/380, 105, 166/377; 418/48; 417/360

[56] References Cited

U.S. PATENT DOCUMENTS 4,171,934 10/1979 Zehren ..... 417/360
4,272,224 6/1981 Kabele ..... 417/360
5,100,302 3/1992 Ceccherini ..... 417/360
5,405,251 4/1995 Sipin ..... 417/423.7 X
5,421,780 6/1995 Vukovic ..... 464/102

*Primary Examiner*—William Neuder

[57] ABSTRACT

A method and related apparatus for the retrieval of a rotary pump from a wellbore while leaving the pump's drive mechanism within the wellbore, comprises lowering a latch mechanism into a wellbore by a cable or coiled tubing and connecting the latch mechanism to the rotary pump suspended within the wellbore. Holding mechanisms, which removably connect the rotary pump to the pump's drive mechanism, are disengaged by pulling of the cable or coiled tubing, or by the application of hydraulic pressure. The latch mechanism and the pump are then retrieved from the wellbore, while the drive mechanism remains suspended within the wellbore.

44 Claims, 3 Drawing Sheets

METHOD AND RELATED APPARATUS FOR RETRIEVING A ROTARY PUMP FROM A WELLBORE

BACKGROUND OF THE INVENTION

1. Field of the Invention

The present invention relates to methods and related apparatus for retrieving a pump from a wellbore and, more particularly, to retrieving a pump while leaving the pump's drive mechanism within the wellbore.

2. Description of Related Art

Subterranean fluids, such as oil, gas and water, are often pumped or "lifted" from wellbore by the operation of downhole pumps, such as by electric submergible pumping systems. These pumping systems typically use an elongated electric motor installed within the wellbore to rotate a multistage centrifugal pump. While centrifugal pumps are widely used for the recovery of subterranean fluids, such centrifugal pumps have difficulty in lifting viscous fluids, such as from Southern California, and fluids with relatively high concentrations of sand and other abrasive materials, such as from the tar sands area of Alberta, Canada. Thus, there is a need for a downhole pump that can lift such fluids.

A solution to the problem of recovering viscous fluids and fluids with relatively high concentrations of sand, consists of using a Moineau pump or a progressive cavity pump. Conventional installations of progressive cavity pumps place the drive means at the earth's surface. A rod string which is used as a drive shaft rotates inside the production tubing. In wells that are deviated and/or produce abrasives, the rotating rod string causes production tubing wear. The frequent replacement of production tubing is very expensive and can cause a well to be uneconomic.

A problem encountered with progressive cavity pumps is that the seal formed between the rotor and stator wears away, reducing the pump's efficiency until it eventually stops pumping fluid, thus the pump needs to be retrieved from the wellbore periodically. Since the pump is rigidly connected to the downhole drive mechanism, when the pump is retrieved the entire downhole drive mechanism is also retrieved, which is a time consuming and a relatively expensive operation that requires a workover rig. The downhole drive mechanisms have operational lives many times longer than the progressive cavity pump, so there is a need for a method and apparatus for retrieving the pump alone and while keeping the downhole drive mechanism within the wellbore. With such a method the size of the pulling unit can be reduced, and thereby save time and money.

SUMMARY OF THE INVENTION

The present invention has been contemplated to overcome the foregoing deficiencies and meet the above described needs. Specifically, the present invention is a method and related apparatus for the installation and retrieval of a rotary pump from a wellbore while leaving the pump's drive mechanism within the wellbore. A latch mechanism is lowered into the wellbore by a cable or coiled tubing, and is connected to the rotary pump. Holding mechanisms, which removably connect the rotary pump to the pump's drive mechanism, are disengaged by pulling of the cable or coiled tubing, or by the application of hydraulic pressure. The latch mechanism and the pump are then retrieved from the wellbore, while the drive mechanism remains suspended within the wellbore.

DETAILED DESCRIPTION OF THE PREFERRED EMBODIMENTS

Figure 1:
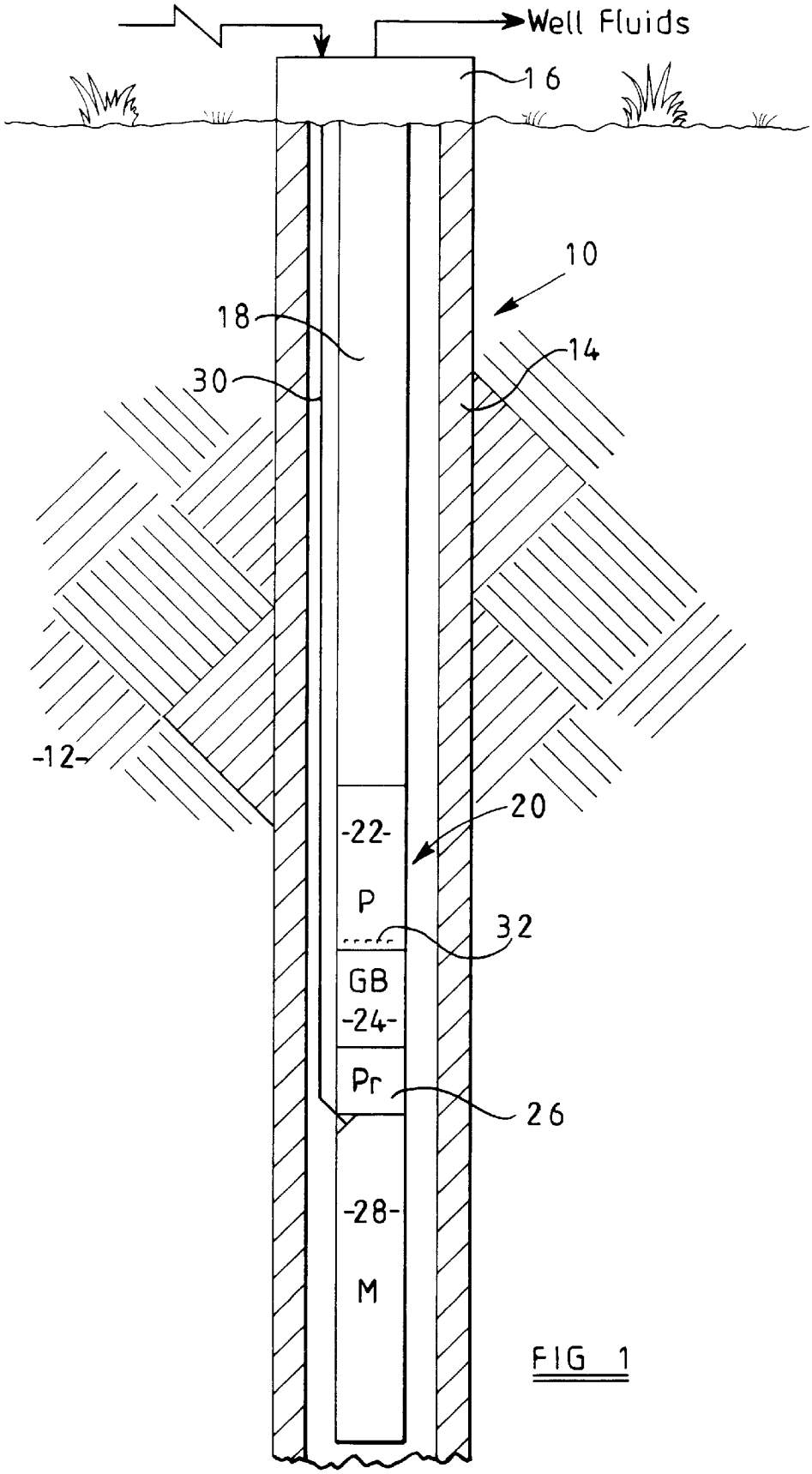
FIG. 1 is an elevational view of a pump connected to an electric motor suspended within a wellbore in accordance with one preferred method of the present invention.

As stated briefly before, the present invention comprises a method and related apparatus for the installation and retrieval of a rotary pump from a wellbore while leaving the pump's drive mechanism within the wellbore. One preferred embodiment of the present invention comprises lowering a latch mechanism into a wellbore by a cable or coiled tubing and connecting the latch mechanism to the rotary pump suspended within the wellbore. Holding mechanisms, which removably connect the rotary pump to the pump's drive mechanism, are disengaged by pulling of the cable or coiled tubing, or by the application of hydraulic pressure. The latch mechanism and the pump are then retrieved from the wellbore, while the drive mechanism remains suspended within the wellbore.

The rotary pump discussed herein can be any type of rotary pump that is used to recover wellbore fluids, such as a centrifugal pump, progressive cavity pump, vane pump, turbine, gear pump, and the like. For the purpose of the discussion hereafter, it will be assumed that the rotary pump is a progressive cavity pump.

For the purposes of the present discussion, the term "drive mechanism" refers to the downhole assembly that provides rotary drive motion to the pump. At a minimum, the drive mechanism comprises an elongated submergible electric motor, and will usually also include one or more oil-filled motor protectors, which are well known to those skilled in the art. When a progressive cavity pump is used with an submergible electric motor, it is preferred to include a gear reduction drive to lower the RPM and increase the torque applied to the pump. In addition to a gear reduction drive, an articulated coupling, flexible rod or joint assembly is preferred to permit limited lateral displacement of the drive shafts. Such a preferred joint assembly is described in U.S. Pat. No. 5,421,780.

For the purposes of the present discussion, the term "latch mechanism" means any conventional wireline, cable, continuous or jointed sucker rod or coiled tubing deployed landing nipple and/or fishing tool that has finger members, hooks, grapples, latches or the like that releasably connect with an exterior of a protrusion on or associated with the pump, or with an interior recess on or associated with the pump. Such devices are well known to those skilled in the art, and are widely commercially offered by divisions of Camco Products & Services Company, Dowell Schlumberger and Baker Hughes Incorporated.

Lastly, the latch mechanism used to retrieve the pump is preferably deployed, i.e., lowered into the wellbore, manipulated or rotated, and raised or pulled from the wellbore, on the end of conventional wireline, multi-strand braided cable, continuous or jointed sucker rod or coiled tubing. The weight of the pump may be greater than the load limit of conventional wireline, and coiled tubing may not be the most economical due to its relatively higher rig costs, so multi-strand braided cable is the most preferred method of deploying the latch mechanism.

To aid in the understanding of the present invention, reference is made to the accompanying drawings. FIG. 1 illustrates a wellbore 10 adapted to recover subterranean fluids, such as oil, gas and/or water, from one or more subterranean earthen formations 12. The wellbore 10 includes a casing string 14 which is connected at the earth's surface to a well head and production tree 16, which includes appropriate valving and piping, as is well known to those skilled in the art. Suspended within the wellbore 10 on a production tubing string 18 is an electric submergible pumping system 20. The tubing string 18 can be conventional jointed tubing or coiled tubing, as is desired. Further, the pumping system 20 can be suspended by cable, if desired. The pumping system 20, for the purposes of the present discussion, comprises a Moineau pump or a progressive cavity pump 22 connected at an upper portion thereof to the tubing string 18 for the transport of the subterranean fluids to the earth's surface. Connected to a lower end of the pump 22 is one or more optional gear reduction drives 24, one or more optional oil-filled electric motor protectors 26, and connected below the motor protector 26 is one or more elongated submergible electric motors 28. Electrical power is supplied to the motor 28 by a cable 30.

As is well known to those skilled in the art, fluids from the subterranean formations 12 enter through openings or perforations (not shown) in the casing 14, and the fluids are transported past the exterior of the electric motor 28 to enter one or more openings 32 in a lower portion of the pump 22. Once the fluids enter the opening(s) 32, the fluids are transported upwardly through the pump 22 by the rotation of the helix-shaped rotor (not shown), within the corresponding helix-shaped stationary stator (not shown) and the fluids are then transported upwardly through the production tubing 18 to the earth's surface.

As stated earlier, a problem encountered with the use of progressive cavity pumps is that the seal formed between the rotor and stator wears away, reducing the pump's efficiency until it eventually stops pumping fluid. Thus, the pump needs to be periodically retrieved from the wellbore. In the past, the pump was rigidly connected to the downhole drive mechanism, so that when the pump was retrieved the entire downhole drive mechanism also was retrieved. The inventors hereof have developed methods and related apparatus for disconnecting and reconnecting the pump from the drive mechanism while both are in a wellbore, and then retrieving the pump to the earth's surface.

Figure 2:
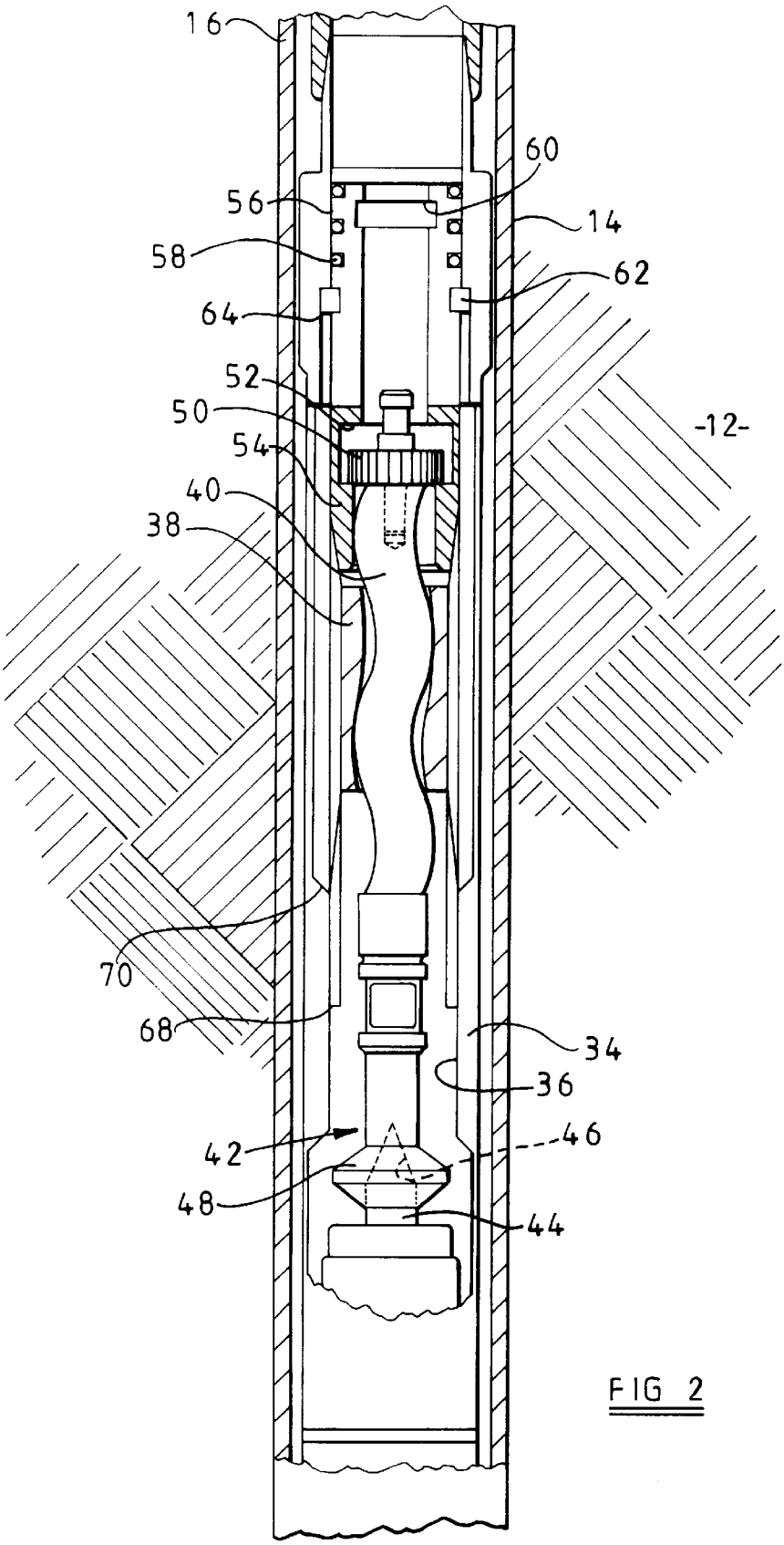
FIG. 2 is an elevational, partial cutaway view of one preferred embodiment of a pump assembly of the present invention.

One preferred method and related apparatus is shown in FIG. 2, wherein a progressive cavity pump 22 is received within a mandrel 34. The pump 22 is adapted to move longitudinally within a longitudinal bore 36 extending through the mandrel 34, as will be described in detail below. A first or lower end of the mandrel 34 is connected by threads to the housing of the optional gear drive 24, the optional motor protector 26, or to the motor 28. A second or upper end of the mandrel 34 is connected by threads to a lower end of the production tubing string 18.

As shown in FIG. 2, the pump 22 comprises a stationary stator 38 within which rotates a helical rotor 40. A first or lower end of the rotor 40 includes a drive coupling 42, which can be any conventional drive train connection that permits longitudinal slippage or movement; however, a splined connection is preferred. Specifically, a beveled splined shaft 44 extends from the gear drive 24, the motor protector 26, or to the motor 28, whichever is located adjacent the pump 22. This splined shaft 44 is received into a corresponding beveled splined bore 46 in an enlarged end of a shaft 48 connected to the rotor 40.

A second or upper end of the rotor 40 includes a flange 50 that is contained within an annular recess 52 in the stator housing of the pump 22 or in a cylindrical adapter 54, which is connected to the second or upper end of the pump 22. The flange 50 prevents the rotor 40 from exiting the stator 38 while the pump 22 is in operation and while the pump 22 is being removed and installed within the wellbore 10. The flange is intended to run between the upper and lower limits such that is not rubbing on either during normal rotation. In addition, a second or upper end of the rotor 40 can include a flanged neck for cooperation with a conventional retrieval or fishing tool, as is well known to those skilled in the art.

A cylindrical cap member 56 is threaded or pinned to the second or upper end of the pump 22, or cylindrical adapter 54, and contains the means by which a retrieval tool (not shown) can connect with the pump 22 to retrieve same. The cap member 56 can be any conventional wireline or fishing landing nipple (or locking mandrel) or similar device, as is well known to those skilled in the art. In the embodiment shown in FIG. 2, the cap member 56 is rigidly connected by threads, pins or welding to the second or upper end of the pump 22 or cylindrical adapter 54, and includes a plurality of annular sealing rings 58 that seal against an interior surface of the bore 36 of the mandrel 34. The cap member 56 also includes an annular recess 60 adjacent a second or upper end of the cap member 56, which is adapted to receive the retrieval tool, as will be described in more detail below.

To prevent the pump 22 from moving longitudinally (i.e., up and down) within the mandrel 34 and/or from turning or moving rotationally with respect to the mandrel 34, holding mechanisms are provided in the cap member 56, the mandrel 34 and/or the pump 22. The holding mechanisms can be electrical, pneumatic, hydraulic or mechanical in operation. In one embodiment, the holding mechanisms are shear pins that are sheared or are released by longitudinal and/or rotational movement. In the preferred embodiment shown in FIG. 2, the holding mechanisms comprise a plurality of spring biased finger members or dogs 62 that are held in an extended position by the relative position of the cap member 56 to the mandrel 34, by the weight of the pump 22, or in any other commercially well known manner. When the dogs 62 are located in the cap member 56, the dogs 62 are received into radially spaced openings 64 in the mandrel 34, and when the dogs are located in the mandrel 34, the dogs 62 are received into openings 64 in the cap member 56. The dogs 62 are retracted to permit longitudinal and/or rotational movement of the pump 22 with respect to the mandrel 34 by any conventional rotational movement, jarring, longitudinal movement either upwards or downwards, or any combination of these, all as are well known to those skilled in the art.

In an alternate embodiment, the dogs 62 are used to only restrict longitudinal movement of the pump 22 with respect the mandrel. Rotational restriction of the pump 22 is provided by a spline (not shown) extending from an outer surface of a lower portion of the pump housing, which cooperates with one or more splines (not shown) included in or attached to and interior surface of the mandrel 34.

Figure 3:
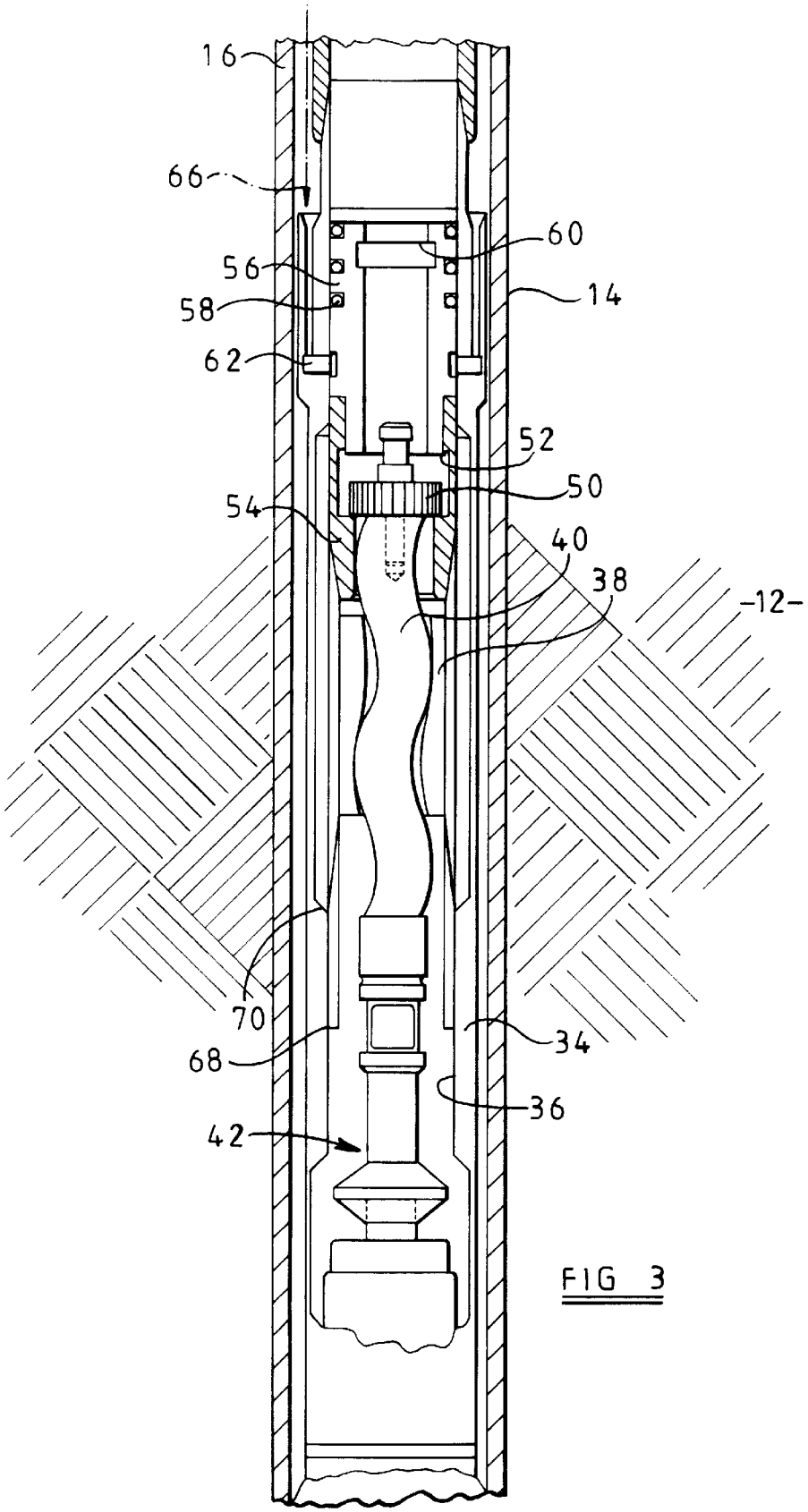
FIG. 3 is an elevational, partial cutaway view of an alternate preferred embodiment of a pump assembly of the present invention.

An alternate preferred embodiment of the present invention is shown in FIG. 3, wherein the dogs 62 are retracted by the application of electrical power or hydraulic pressure from a control line 66 which extends to the earth's surface. Further, the dogs 62 of FIG. 3 can be retracted or extended by the application of fluid pressure to the annulus between the mandrel 34 and the casing 14 that exceeds a predetermined limit, or the creation of a pressure differential that exceeds a predetermined limit between the mandrel-casing annulus and the interior of the tubing 18.

When the submergible pumping system is installed in the wellbore 10, the entire pump assembly is connected together at the earth's surface and then lowered into the wellbore 10 on cable or the tubing string 18, with the power cable 30 banded to the outside thereof, as is well known to those skilled in the art. If and when the pump 22 is to be retrieved, the motor 28 is stopped, and a latch mechanism is lowered into the wellbore 10 by way of wireline, multi-strand braided cable, continuous or jointed sucker rod or coiled tubing. The latch mechanism (not shown) is received into the annular recess 60, and is then manipulated to release the holding mechanisms. In the embodiment shown in FIG. 2, only longitudinal or upward movement of the cap member 56 in relation to the mandrel 34, which is rigidly connected to the pump's drive mechanism, causes the dogs 62 to retract. Upward movement of the cap member 56 also draws the pump 22 out of the mandrel 34, and the splined shaft 44 is withdrawn from the splined bore 46. The latch mechanism, the cap member 56 and the pump 22 are all then retrieved to the earth's surface. The pump's drive mechanism is left suspended within the wellbore 10 since the mandrel 34 is rigidly connected between the tubing 18 and the gear drive 24, motor protector 26 and/or the motor 28.

For the preferred embodiment shown in FIG. 3, electrical power or hydraulic pressure is applied to the dogs 62 through the control line 66, or the desired annular pressure differential is created to cause the dogs 62 to retract.

If desired, the gear drive 24 and/or a motor protector 26 can be rigidly connected to the second end of the pump's rotor 40, with the splined coupling 42 located between the gear drive 24 and a motor protector 26, or if two motor protectors are used then between the first and the second motor protector 26 and/or the pump 22, which is rigidly connected through the mandrel 34 to the tubing 18. In this manner, the pump 22 and the gear drive 24, and optionally a motor protector 26 can be easily retrieved from the wellbore while the remaining portions of the drive mechanism remain in the wellbore 10.

When the pump 22 is to be installed back into the wellbore 10, the latch mechanism is again removably connected to the cap member 56 and/or the pump 22, and the pump 22 is lowered into the wellbore 10. The lower end of the rotor 40 is connected to the drive coupling 42. This drive coupling 42 includes a larger outside diameter area. As the assembly is lowered into the wellbore, the large diameter area passes through the longitudinal bore 36 below which there is a taper to a reduced diameter section, which is slightly larger than the drive coupling 42. As the drive coupling 42 passes through the taper, the drive coupling 42 is centered to allow it to mate with the spline shaft 44. The splines on the bore 46 and the shaft 44 are beveled so that relative downward movement will cause the splines and shafts to slightly rotate and become connected. As the unit is lowered farther down, the large diameter section of the drive coupling 42 passes completely through and is clear of the reduced diameter. This allows the drive coupling to oscillate with the pump rotor as required. As the bore 46 and shaft 44 are mating, an external or male spline, which is connected to the second or lower end of the pump, is mating with the internal spline connected to the mandrel 34. The splines on the bore and the lower pump housing are beveled so that relative downward movement will cause the splines and shafts to slightly rotate and become connected. A step on the shoulder 68 contacts the shoulder 70 and prevents further downward movement.

A second embodiment employs a male spline on the bottom of the drive connection 42. This embodiment uses a flexible drive mechanism to remain in the wellbore with the drive unit. The lower end of the rotor 40 is connected to the drive coupling 42, which includes a larger outside diameter area. As the assembly is lowered into the wellbore, the large diameter area passes through the longitudinal bore 36 below which there is a taper to a reduced diameter section, which is slightly larger than the drive coupling 42. As the drive coupling 42 passes through the taper, the drive coupling 42 is centered to allow it to mate with the internal spline shaft 44. As described above, the splines on the bore and the shaft are beveled so that relative downward movement will cause the splines and shafts to slightly rotate and become connected. As the unit is lowered farther down, the large diameter section of the drive coupling 42 passes completely through and is clear of the reduced diameter section. This allows the drive coupling to oscillate with the pump rotor as required. As the bore and shaft are mating, the external or male spline, which is connected to the second or lower end of the pump, is mating with the internal spline connected to the mandrel 34. The splines on the bore and the lower pump housing are beveled so that relative downward movement will cause the splines and shafts to slightly rotate and become connected.

When the pump 22 is almost landed within the mandrel 34 the spring biased dogs 62 contact the upper end of the mandrel 34 and are pushed inwardly into a retracted position. Alternately, the dogs 62 are retracted at the surface and stay that way until they are released at or adjacent the openings 64. As the pump 22 is continued to be lowered the spring biased dogs 62 extend against and then into the openings 64, thereby locking the pump assembly within the mandrel 34 from longitudinal and/or rotational movement until the pump 22 is to be retrieved again.

With this retrieval method and related apparatus the power cable 30 and the control line 66 (if used) are isolated from any moving members so as not to be damaged, as sometimes occurs when pumps and drive mechanisms are removed from the well, because the cable 30 and the control line 66 are outside of the mandrel 34 and the tubing string 18.

As can be understood from the above discussions, the present invention provides a relatively quick and inexpensive way to retrieve a pump without the need for retrieving the pump's drive mechanism, with all of its inherent costs and potential for damage.

Whereas the present invention has been described in particular relation to the drawings attached hereto, it should be understood that other and further modifications, apart from those shown or suggested herein, may be made within the scope and spirit of the present invention.

What is claimed is:

1. A method of retrieving a rotary pump, connected to a pump drive mechanism, from a wellbore while leaving the pump drive mechanism within the wellbore, comprising:

(a) lowering a latch mechanism into the wellbore and connecting the latch mechanism to the pump suspended within the wellbore;

(b) disengaging holding mechanisms, which removably connect the pump to the pump drive mechanism and prevent longitudinal movement of the pump with respect to the pump drive mechanism, by longitudinal movement of the latch mechanism; and (c) withdrawing the latch mechanism and the pump from the wellbore.

2. A method of retrieving a rotary pump, having a rotary pump drive mechanism, from a wellbore while leaving the rotary pump drive mechanism within the wellbore, comprising:

(a) lowering a latch mechanism into the wellbore and connecting the latch mechanism to the pump suspended within the wellbore;

(b) disengaging holding mechanisms, which removably connect the pump to the pump drive mechanism and prevent longitudinal movement with respect to the pump drive mechanism, by rotational movement of the latch mechanism and pump with respect to the pump drive mechanism; and (c) withdrawing the latch mechanism and the pump from the wellbore.

3. A method of retrieving a rotary pump, connected to a pump drive mechanism, from a wellbore while leaving the pump drive mechanism within the wellbore, comprising:

(a) lowering a latch mechanism into the wellbore and connecting the latch mechanism to the pump suspended within the wellbore;

(b) disengaging holding mechanisms, which removably connect the pump to the pump drive mechanism, by application of hydraulic pressure; and (c) withdrawing the latch mechanism and the pump from the wellbore.

4. A method of retrieving a rotary pump, connected to a pump drive mechanism, from a wellbore while leaving the pump drive mechanism within the wellbore, comprising:

(a) lowering a latch mechanism into the wellbore by a cable and connecting the latch mechanism to the pump suspended within the wellbore;

(b) disengaging mechanical holding mechanisms, which removably connect the pump to the pump drive mechanism, by pulling of the cable; and (c) withdrawing the cable, latch mechanism and the pump from the wellbore.

5. A method of retrieving the rotary pump of claim 4 wherein the cable is wireline.

6. A method of retrieving the rotary pump of claim 4 wherein the cable is multi-strand.

7. A method of retrieving the rotary pump of claim 4 wherein the holding mechanisms comprise biased members that, when extended, prevent the pump from longitudinal movement with respect to the drive mechanism.

8. A method of retrieving the rotary pump of claim 4 wherein the pump is received within a mandrel, with one end of the mandrel connected to the pump's drive mechanism.

9. A method of retrieving the rotary pump of claim 8 wherein a second end of the mandrel is connected to a production tubing suspended within the wellbore.

10. A method of retrieving the rotary pump of claim 8 wherein the holding mechanisms removably connect the pump to the interior of the mandrel.

11. A method of retrieving the rotary pump of claim 4 wherein one end of the pump has a drive shaft that is removably connected to a drive shaft of the pump's drive mechanism.

12. A method of retrieving the rotary pump of claim 11 wherein when the pump is retrieved from the mandrel, the pump's drive shaft is longitudinally withdrawn from interconnection with the drive shaft of the pump's drive mechanism.

13. A method of retrieving the rotary pump of claim 4 wherein the pump is a progressive cavity pump.

14. A method of retrieving a rotary pump, connected to a pump drive mechanism, from a wellbore while leaving the pump drive mechanism within the wellbore, comprising:

(a) lowering a latch mechanism into the wellbore by a cable and connecting the latch mechanism to the pump suspended within the wellbore;

(b) disengaging holding mechanisms, which removably connect the pump to the pump's drive mechanism, by application of hydraulic pressure; and (c) withdrawing the cable, latch mechanism and the pump from the wellbore.

15. A method of retrieving the rotary pump of claim 14 wherein the cable is logging wireline.

16. A method of retrieving the rotary pump of claim 14 wherein the cable is braided multi-strand cable.

17. A method of retrieving the rotary pump of claim 14 wherein the holding mechanisms comprise biased members that, when extended, prevent the pump from longitudinal and rotational movement with respect to the drive mechanism.

18. A method of retrieving the rotary pump of claim 14 wherein the pump is received within a mandrel, with one end of the mandrel connected to the pump's drive mechanism.

19. A method of retrieving the rotary pump of claim 18 wherein a second end of the mandrel is connected to a production tubing suspended within the wellbore.

20. A method of retrieving the rotary pump of claim 18 wherein the holding mechanisms removably connect the pump to the interior of the mandrel.

21. A method of retrieving the rotary pump of claim 14 wherein one end of the pump has a drive shaft that is removably connected to a drive shaft of the pump's drive mechanism.

22. A method of retrieving the rotary pump of claim 21 wherein when the pump is retrieved from the mandrel, the pump's drive shaft is longitudinally withdrawn from interconnection with the drive shaft of the pump's drive mechanism.

23. A method of retrieving the rotary pump of claim 14 wherein the holding mechanisms comprise pistons that are retracted by application of hydraulic pressure.

24. A method of retrieving the rotary pump of claim 23 wherein the pistons are retracted by the application of hydraulic pressure through a control line that extends to the earth's surface.

25. A method of retrieving the rotary pump of claim 14 wherein the pump is a progressive cavity pump.

26. A rotary pump assembly for removable interconnection to a downhole drive mechanism, comprising:

a mandrel having means on a first end for connection to the downhole drive mechanism;

a rotary pump received within the mandrel;

means on a first end of the rotary pump for removable interconnection to a drive shaft of the drive mechanism; and means on a second end of the rotary pump for removable interconnection to a retrieval tool.

27. A rotary pump assembly of claim 26 wherein the rotary pump is a progressive cavity pump.

28. A rotary pump assembly of claim 26 wherein a second end of the mandrel includes means for connection to a tubing string.

29. A rotary pump assembly of claim 26 wherein the first end of the mandrel is connected to a housing of the drive mechanism.

30. A rotary pump assembly of claim 26 wherein the removable interconnection means on the first end of the rotary pump comprises a splined shaft extending from the drive mechanism that is received into a splined bore within a shaft extending from the rotary pump.

31. A rotary pump assembly of claim 26 wherein the second end of the rotary pump includes means to releasably prevent longitudinal movement of the pump with respect to the mandrel.

32. A rotary pump assembly of claim 26 wherein the second end of the rotary pump includes means to releasably prevent rotational movement of the pump with respect to the mandrel.

33. A rotary pump assembly of claim 26 and further comprising holding mechanisms on the second end of the rotary pump, that when extended, prevent the rotary pump from longitudinal movement with respect to the mandrel.

34. A rotary pump assembly of claim 33 wherein the holding mechanisms are retracted by pulling of the retrieval tool.

35. A rotary pump assembly of claim 33 wherein the holding mechanisms are retracted by the application of hydraulic pressure through a control line that extends to a surface of the earth.

36. A rotary pump assembly comprising:

a drive mechanism including a submergible electric motor;

a mandrel connected to the drive mechanism;

a rotary pump received within the mandrel;

means for removably interconnecting the rotary pump to the drive mechanism; and means for removably interconnecting the rotary pump to the mandrel.

37. A rotary pump assembly of claim 36 and further comprising means for releasably preventing longitudinal movement of the rotary pump in relation to the mandrel.

38. A rotary pump assembly of claim 36 and further comprising means for releasably preventing rotational movement of the rotary pump in relation to the mandrel.

39. A rotary pump assembly of claim 36 wherein the rotary pump comprises a progressive cavity pump.

40. A rotary pump assembly of claim 36 wherein the means for removable interconnection of the rotary pump to the mandrel includes means for removable interconnection to a retrieval tool.

41. A rotary pump assembly of claim 36 wherein the retrieval tool is deployed on wireline.

42. A rotary pump assembly of claim 36 wherein the retrieval tool is deployed on multi-strand braided cable.

43. A rotary pump assembly of claim 36 wherein the retrieval tools is deployed on continuous or jointed sucker rod.

44. A rotary pump assembly of claim 36 wherein the retrieval tool is deployed on coiled tubing.

* * * * *